US005395717A

United States Patent [19]

Ozawa et al.

[11] Patent Number: 5,395,717

[45] Date of Patent: Mar. 7, 1995

[54] DEVELOPER FOR DEVELOPING LATENT ELECTROSTATIC IMAGES AND METHOD OF FORMING IMAGES BY USING THE DEVELOPER

[75] Inventors: Yoshio Ozawa; Kazuhiko Sakaguchi; Masahiro Kuru; Noriaki Sakamoto, all of Mie, Japan

[73] Assignee: Kyocera Corporation, Kyoto, Japan

[21] Appl. No.: 62,930

[22] Filed: May 17, 1993

[30] Foreign Application Priority Data

May 18, 1992 [JP] Japan ..... 4-151601
May 18, 1992 [JP] Japan ..... 4-151602
May 18, 1992 [JP] Japan ..... 4-151603

[51] Int. Cl.[6] ..... G03G 9/083
[52] U.S. Cl. ..... 430/106.6; 430/122
[58] Field of Search ..... 430/106.6, 122

[56] References Cited

U.S. PATENT DOCUMENTS 4,578,337 3/1986 Oka ..... 430/107
4,626,487 12/1986 Mitsuhashi et al. ..... 430/106.6
5,103,266 4/1992 Miyamoto et al. ..... 430/125

FOREIGN PATENT DOCUMENTS 57-204560 12/1982 Japan .
62-182755 8/1987 Japan .
63-103264 5/1988 Japan .
1-268177 8/1989 Japan .
2-109059 4/1990 Japan .
2-210358 8/1990 Japan .

*Primary Examiner*—John Goodrow
*Attorney, Agent, or Firm*—Spensley Horn Jubas & Lubitz

[57] ABSTRACT

A developer for developing latent electrostatic images to visible images composed of a magnetic resin carrier composed of magnetic resin particles, each of the magnetic resin particles containing a binder resin and finely-divided magnetic particles dispersed in the binder resin; a magnetic powder carrier consisting essentially of magnetic particles; and an abrasive-type toner composed of toner particles, each of the toner particles containing a toner basic particle and finely-divided particles of an abrasive substance which are fixed on the surface of the toner basic particle. In addition, a method of forming images by use of the above-mentioned developer is disclosed.

31 Claims, 3 Drawing Sheets

DEVELOPER FOR DEVELOPING LATENT ELECTROSTATIC IMAGES AND METHOD OF FORMING IMAGES BY USING THE DEVELOPER

BACKGROUND OF THE INVENTION

1. Field of the Invention

The present invention relates to a developer for developing latent electrostatic images to visible images in a developing process in the fields of electrophotography, electrostatic recording and electrostatic printing; and a method of forming images by using the developer.

2. Discussion of Background

A variety of two-component type developers have been proposed, as disclosed in U.S. Pat. Nos. 2,618,551, 2,618,522, 2,573,881, and 2,638,416 since the invention of an electrophotographic method by C. F. Carlson (U.S. Pat. No. 2,297,691). In addition, after the invention of magnetic brush development (U.S. Pat. No. 2,786,439), many proposals have been made to improve the charging characteristics and moisture-resistance of a developer and prevent the scattering of toner particles in the image forming apparatus by coating a carrier with a resin.

The two-component type developer comprises a toner and a carrier. The toner is charged to a predetermined polarity and transported to a development zone by the action of the carrier, and only the toner is attached to an electrostatic latent image to develop it to a visible toner image.

For example, a non-coated carrier comprises magnetic particles such as iron particles, magnetite particles, and ferrite particles. This kind of magnetic powder carrier is simple in structure and excellent in durability. However, the toner cannot satisfactorily be charged by the magnetic powder carrier because the resistivity of the carrier is relatively small, thereby producing the problem of toner particles scattering in the image forming apparatus and the problem of fogging. Furthermore, due to a relatively heavy weight of the magnetic powder carrier, the toner is easily deposited on the carrier to induce the spent phenomenon while the toner and the carrier are mixed and stirred in a development unit. When the spent phenomenon occurs, the charge-imparting capability of the carrier deteriorates, which has an adverse effect on the obtained images, such as occurrence of fogging and decrease of image density. Consequently, the life span of the developer is reduced and regular replacement of the developer becomes inevitable.

A coated-type magnetic powder carrier prepared by coating the surfaces of the magnetic particles with a resin can prevent the scattering of toner particles in the image forming apparatus and the fogging of the obtained images. This is because the resistivity of the coated-type magnetic powder carrier is increased, and therefore, the charging characteristics of the toner can be improved. However, it is inevitable that the coated resin layer be peeled away from the magnetic particle during the repeated operations. In this case, the toner particles are scattered in the image forming apparatus, and the fogging phenomenon occurs. Particularly, the coated resin layer is easily peeled away to decrease the durability of the carrier in a small-sized image forming apparatus equipped with a compact development unit because a large shear force is applied to the carrier in such a small-sized development unit in the course of mixing and stirring of the carrier and the toner.

There are conventionally known a magnetic resin carrier with a small diameter, prepared by dispersing finely-divided magnetic particles in a binder resin, and a coated-type magnetic resin carrier prepared by coating the above-mentioned magnetic resin particles with a resin, as disclosed in Japanese Laid-Open Patent Applications 47-13954, 49-51950 and 50-2543. Owing to the presence of a resin, not only the resistivity of the magnetic resin carriers is increased to improve the capability of imparting the charge to the toner, but also it is possible to weaken the stress applied to the carrier to lengthen the life of the obtained developer, as reported in "Plain Paper Copier for High Image Quality Using New Process and New Developing Materials" (National Technical Report, Vol. 26, No. 4, Aug., (1982)). However, since the specific gravity, that is, the true density of the magnetic resin carrier is small, the carrier is easily attracted to the surface of an electrophotographic photoconductor and deposited on latent electrostatic images thereon together with the toner in the course of the development process.

Furthermore, a developer disclosed in Japanese Laid-Open Patent Application 59-192262 comprises an electrically insulating toner, and a mixture of a magnetic resin carrier comprising a binder resin and finely-divided magnetic particles dispersed in the binder resin and a magnetic carrier comprising ferromagnetic powder. This developer forms a magnetic brush with flexible fibers, and avoids the coagulation of the magnetic carrier particles. However, the toner for use in this developer is a conventional electrically-insulating toner, so that the spent phenomenon occurs during the continuous printing operation, thereby degrading the quality of the obtained images.

The addition of a third material to the toner and the carrier is proposed to prevent the deterioration of the carrier, as reported in a paper entitled "PPF Method and How to Improve the Quality of Copied Images" by Makoto Sumida in the Journal of the Institute of Electrophotography Engineers of Japan, Vol. 23, No. 1, (1984). In this case, it is difficult to maintain the image density constant because the above-mentioned third material is easily attracted to the photoconductor together with the toner.

In the development system in which the toner clings to the carrier by electrostatic attraction, the electrostatic adhesion between the toner and carrier varies depending on the environmental change. Particularly, the toner is easily scattered in the image forming apparatus in the atmosphere of high humidities. The reason for the decrease in electrostatic adhesion between the toner and the carrier is considered that the spent toner is attached to the surface of the carrier, and therefore, some toner particles are insufficiently charged and others are charged to a polarity opposite to the predetermined one.

With respect to a photoconductor, attention has recently been paid to an a-silicon (amorphous silicon) based photoconductor in addition to the conventional Se-based photoconductor and an organic semiconductor. The a-silicon (hereinafter referred to as a-Si) based photoconductor is superior to the Se-based photoconductor in terms with the safety and durability. The life of the a-Si based photoconductor is longer than that of the image forming apparatus itself.

However, the a-Si based photoconductor is apt to induce the so-called image blurring because the electric charge readily leaks from the photoconductor when the operation is extended over a long period of time.

To solve the blurring problem, an abrasive substance is conventionally utilized. More specifically, the addition of finely-divided particles of strontium titanate to a developer is proposed, as disclosed in Japanese Laid-Open Patent Application 61-278861; a cleaning member with a Mohs hardness of 2.5 to 7.0 is used, as in Japanese Laid-Open Patent Application 59-88776; and finely-divided abrasive particles with almost the same Mohs hardness as that of a surface layer of the a-Si based photoconductive drum is contained in a developer as in Japanese Laid-Open Patent Application 63-29759. Further, as reported in Japanese Laid-Open Patent Application 61-231564, the addition of an alkaline earth metal and carbonate to the developer is effective for preventing the blurring from happening on the a-Si based photoconductor.

However, the abrasive effect obtained by any of the above-mentioned methods with respect to the surface of the a-Si based photoconductor is insufficient to prevent the blurring on the photoconductor. To obtain a desired abrasive effect, the image forming apparatus necessarily becomes large in size, and the aforementioned abrading methods cannot be applied to a small-sized image forming apparatus.

Japanese Laid-Open Patent Application 59-192262 discloses a developer for use in electrophotography, which comprises an electrically insulating toner, a magnetic carrier comprising magnetic particles, and a magnetic resin carrier comprising a binder resin and finely-divided magnetic particles dispersed in the binder resin. The above application does not make any suggestion about the combination of the abrasive-type toner component and the carrier component.

The fixing of ceramic particles to the developer and the use of such a developer are described in Japanese Laid-Open Patent Applications 63-85756, 63-103264, 1-196072, 3-203743 and 3-43747.

The surface-modification of a basic particle by fixing finely-divided particles on the basic particle is described in Japanese Patent Publications 3-2009, 3-76177 and 4-3250, Japanese Laid-Open Patent Applications 62-262737 and 62-298443 and Japanese Utility Model Publication 4-45538.

SUMMARY OF THE INVENTION

Accordingly, a first object of the present invention is to provide a developer for developing latent electrostatic images, capable of constantly forming high quality images without the spent phenomenon of a carrier.

A second object of the present invention is to provide an image formation method by which high quality images can be constantly formed, with the spent phenomenon of a carrier being prevented.

The first object of the present invention can be achieved by a developer for developing latent electrostatic images to visible images, comprising a magnetic resin carrier comprising magnetic resin particles, each of the magnetic resin particles comprising a binder resin and finely-divided magnetic particles dispersed in said binder resin; a magnetic powder carrier consisting essentially of magnetic particles; and an abrasive-type toner comprising toner particles, each of the toner particles comprising a toner basic particle and finely-divided particles of an abrasive substance which are fixed on the surface of the toner basic particle.

The second object of the present invention can be achieved by an image forming method comprising the steps of forming latent electrostatic images on the surface of an amorphous-silicon-based photoconductive layer of an amorphous-silicon-based photoconductor; and developing the latent electrostatic images to visible toner images formed on the amorphous-silicon-based photoconductive layer by use of a developer comprising a magnetic resin carrier comprising magnetic resin particles, each of the magnetic resin particles comprising a binder resin and finely-divided magnetic particles dispersed in the binder resin, a magnetic powder carrier consisting essentially of magnetic particles, and an abrasive-type toner comprising toner particles, each of the toner particles comprising a toner basic particle and finely-divided particles of an abrasive substance which are fixed on the surface of the toner basic particle.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
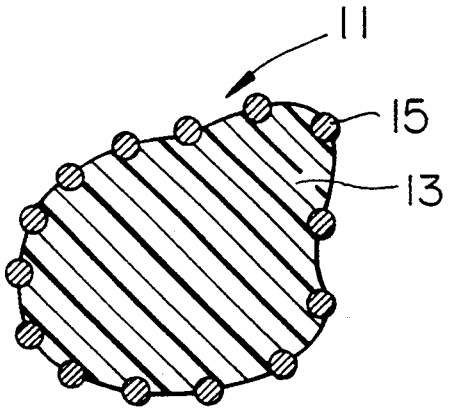
FIG. 1 is a schematic cross-sectional view of one embodiment of a toner particle for use in a developer of the present invention.

A carrier component for use in a developer of the present invention comprises a magnetic resin carrier and a magnetic powder carrier.

The magnetic resin carrier comprises magnetic resin core particles, each of the magnetic resin core particles comprising a binder resin and finely-divided magnetic particles dispersed in the binder resin. Each magnetic resin core particle may be coated by a resin to form a coated-type magnetic resin carrier. Alternatively, positively- or negatively-chargeable finely-divided particles may be fixed on the surface of the magnetic resin core particles of the magnetic resin carrier. The charging characteristics of the magnetic resin carrier, such as a polarity thereof, can be controlled by selecting the kind of binder resin for use in the magnetic resin core particle, the kind of resin coated on the surface of the magnetic resin core particle, and the kind of chargeable finely-divided particles fixed thereon.

Examples of the binder resin for use in the magnetic resin core particles of the magnetic resin carrier are thermoplastic resins, for example, vinyl resins such as polystyrene resin, polyester resins, nylon resins and polyolefin resins; and cured resins such as phenolic resins.

As the magnetic finely-divided particles which are dispersed in the above-mentioned binder resin, a spinel ferrite such as magnetite or gamma-iron-oxide; a spinel ferrite comprising at least one metal, except iron, such as Mn, Ni, Mg or Cu; a magnetoplumbite-type ferrite such as barium ferrite; and finely-divided particles of iron or alloys thereof having a surface oxidized layer can be employed in the present invention. The shape of the magnetic finely-divided particles may be a granule, a sphere or a needle.

In the case where the magnetic resin carrier for use in the present invention is required to be highly magnetized, finely-divided particles of a strongly magnetic substance such as iron may be employed. It is preferable that finely-divided particles of a strongly magnetic substance, that is, the above-mentioned spinel ferrite such as magnetite or gamma-iron-oxide, and magnetoplumbite-type ferrite such as barium ferrite be used as the magnetic particles for use in the magnetic resin carrier, with the chemical stability taken into consideration.

The magnetic resin carrier with a desired magnetic force can be obtained by appropriately selecting the kind of finely-divided particles of the strongly magnetic substance serving as the magnetic finely-divided particles and the content thereof. It is proper that the amount of the magnetic finely-divided particles be 50 to 90 wt. % of the total weight of the magnetic resin carrier.

The aforementioned magnetic resin carrier for use in the present invention can be prepared by the following methods:

(1) Magnetic finely-divided particles and an electrically insulating binder resin are fused and mixed with the application of heat thereto, and then the thus obtained mixture is cooled and pulverized.
(2) A mixture of the fused magnetic finely-divided particles and electrically insulating binder resin is subjected to spray drying.
(3) Monomers or prepolymers are polymerized and cured in an aqueous medium in the presence of magnetic finely-divided particles to prepare a magnetic resin carrier in which magnetic finely-divided particles are dispersed in a condensation-type binder resin.

The thus obtained magnetic resin core particle of the magnetic resin carrier may be subjected to surface-modification by coating a resin on the surface of the magnetic resin core particle, or by fixing positively- or negatively-chargeable particles or electroconductive finely-divided particles thereon, in order to control the charging characteristics of the obtained magnetic resin carrier.

Examples of the resin which is coated on the surface of the magnetic resin core particle include silicone resin, acrylic resin, epoxy resin, and fluororesin. Such a resin is coated on the surface of the magnetic resin core particle and cured to form a surface layer, thereby improving the charge-imparting capability of the carrier. When a coated-type magnetic resin carrier is prepared by coating the magnetic resin core particles with a resin or fixing the chargeable finely-divided resin particles on the surface of the magnetic resin core particles, the charge-imparting capability of the carrier is improved, thereby obtaining excellent image quality.

To fix the chargeable finely-divided particles or electroconductive finely-divided particles on the surface of the magnetic resin core particles of the magnetic resin carrier, for instance, the magnetic resin core particles and the chargeable finely-divided particles or electroconductive finely-divided particles are uniformly mixed in such a fashion that the chargeable particles or electroconductive particles may adhere to the surface of each magnetic resin core particle. Subsequently, these chargeable particles or electroconductive particles are fixed to the magnetic resin core particle with the application of mechanical or thermal shock thereto, so as no to completely embed the chargeable or electroconductive particles into the magnetic resin core particle, but to allow part of the chargeable or electroconductive particles to protrude over the magnetic resin core particle. This fixing method is applicable to the case where abrasive finely-divided particles are fixed to toner basic particles, which will be described later.

Examples of the chargeable finely-divided particles are organic and inorganic electrically insulating materials. Specific examples of the organic electrically insulating material include finely-divided particles of polystyrene, styrene-based copolymer, acrylic resin, acryl-based copolymer, nylon, polyethylene, polypropylene, fluororesin, and crosslinked products thereof. A desired charging level and polarity can be obtained by selecting a proper material, polymerization catalyst, and method of surface treatment. Specific examples of the inorganic electrically insulating material include negatively-chargeable finely-divided particles, such as silica and titanium dioxide, and positively-chargeable finely-divided particles, such as alumina.

Examples of the electroconductive finely-divided particles include carbon black, tin oxide, electroconductive titanium oxide which is prepared by coating an electroconductive material on titanium oxide, and silicon carbide. It is desirable that the electroconductive materials not losing its electroconductivity by oxidation in the air be used as the electroconductive finely-divided particles for use in the present invention.

It is preferable that the average particle diameter of the magnetic resin carrier be 10 to 100 μm, more preferably 20 to 80 μm, and further preferably 30 to 70 μm.

The saturation magnetization of the magnetic resin carrier in a magnetic field of 5 kOe is preferably 60 to 90 emu/g, and more preferably in the range from 70 to 85 emu/g.

The carrier component for use in the developer of the present invention comprises a magnetic powder carrier consisting essentially of magnetic particles. The same magnetic particles as employed in the previously mentioned magnetic finely-divided particles, such as particles of iron, magnetite and ferrite, can be used for the magnetic powder carrier. In particular, the surface of the ferrite particles is remarkably hard, so that these particles are not abraded by the abrasive-type toner particles. The magnetic particles for use in the magnetic powder carrier may be coated with a resin to form a coated-type carrier, but it is preferable that the magnetic particles be used as they are, namely, in the form of a non-coated carrier, from the viewpoint of the durability.

It is preferable that the average particle diameter of the magnetic powder carrier be 10 to 100 μm, more preferably 20 to 80 μm, and further preferably 30 to 70 μm.

The saturation magnetization of the magnetic powder carrier in a magnetic field of 5 kOe is preferably 55 to 90 emu/g, and more preferably in the range from 60 to 70 emu/g.

In the present invention, the carrier comprises the magnetic resin carrier and the magnetic powder carrier, which have the respective functions. The magnetic resin carrier mainly serves to charge the toner, while the magnetic powder carrier serves to transport the toner and mix the carrier and the toner.

Since the true specific gravity and the apparent specific gravity of the magnetic resin carrier are smaller than those of the magnetic powder carrier, the surface area of the magnetic resin carrier per unit weight is large. Therefore, even a small amount of the magnetic resin carrier has sufficient capability of imparting charge to the toner. In addition, the spent toner is scarcely attached to the magnetic resin carrier, and the magnetic resin carrier can buffer the physical impact applied thereto by the magnetic particles for use in the magnetic powder carrier in the course of stirring in a development unit of a small-sized image forming apparatus where a large shear force is applied thereto in preparation of the developer by mixing and stirring the carrier and the toner. Furthermore, the stress applied to the magnetic resin carrier is relatively small in the course of stirring. Therefore, even when the surface-treated magnetic resin carrier, for example, by coating the magnetic resin core particle with a resin, is employed, the resin layer formed on the core particle is not easily abraded and peeled by contact with the abrasive-type toner particles. The magnetic resin carrier for use in the present invention has the above-mentioned advantages, and it can steadily impart a constant charge to the toner not only by containing a Charge controlling agent in the magnetic resin carrier, but also by coating the magnetic resin core particle of the magnetic resin carrier with a resin or subjecting it to any other surface treatment. In addition, the magnetic resin carrier is capable of forming a magnetic brush with flexible fibers, so that the latent electrostatic images can faithfully be reproduced.

By use of the magnetic powder carrier, on the other hand, the magnetic resin carrier can be prevented from being attracted to the photoconductor together with the toner particles.

When the magnetic resin carrier is used alone as the carrier component, the carrier is easily attracted to the photoconductor, and consequently white spots appear in the obtained images. This is because the specific gravity of the magnetic resin carrier is small, the charge quantity per unit weight, namely, the specific charge (Q/M) is large, and the magnetic force is relatively weak.

To make the best use of the function of the magnetic resin carrier, it is desirable to decrease the average particle diameter thereof, for example, to 100 μm or less. However, the carrier is more easily be attracted to the photoconductor when the particle diameter is small. In contrast to this, when the average particle diameter of the magnetic resin carrier is large, the obtained image becomes harsh and the toner concentration cannot be increased more than a certain level.

When the magnetic resin carrier is used in combination with the magnetic powder carrier, the magnetic powder carrier plays a most important part in a magnetic brush formed on a development sleeve. Therefore, when the magnetic brush is separated from a development zone on the photoconductor, the magnetic resin carrier is attracted to the magnetic powder carrier, thereby preventing the magnetic resin carrier from moving to the photoconductor together with the toner particles.

The mixing ratio of the magnetic resin carrier to the magnetic powder carrier is determined in accordance with the desired charge quantity of the toner. More specifically, when the desired charge quantity of the toner is low, the specific charge (Q/M) of the obtained developer can be controlled by increasing the amount of the magnetic resin carrier which acquires a charge of the opposite polarity to that of the toner. It is preferable that the mixing ratio by weight of the magnetic resin carrier to the magnetic powder carrier be in the range of (5–75):(95–25), and more preferably in the range of (5–50):(95–50).

FIG. 1 is a schematic cross-sectional view of one embodiment of a toner for use in a developer of the present invention. In FIG. 1, a toner particle 11 comprises a toner basic particle 13 and finely-divided particles of an abrasive substance 15 (hereinafter referred to as abrasive particles 15) fixed on the surface of the toner basic particle 13.

To fix the abrasive particles 15 on the surface of the toner basic particle 13, for example, the toner basic particles 13 and the abrasive particles 15 are uniformly mixed in such a fashion that the abrasive particles 15 may adhere to the surface of each toner basic particle 13. Subsequently, these abrasive particles 15 are fixed to the toner basic particle 13 with the application of mechanical or thermal shock thereto, so as not to completely embed the abrasive particles 15 into the toner basic particle 13, but to allow part of the abrasive particles 15 to protrude over the toner basic particle 13.

The apparatus for fixing the abrasive particles 15 on the toner basic particle 13 is commercially available as a surface-modification apparatus or surface-modification system.

For example:

(1) Dry-type mechanochemical method

"Mechanomill" (Trademark), made by Okada Seiko Co., Ltd.

"Mechanofusion System" (Trademark), made by Hosokawa Micron Corporation.

(2) High-velocity impact method

"Hybridization System" (Trademark), made by Nara Machinery Co., Ltd.

"Kryptron" (Trademark), made by Kawasaki Heavy Industries, Ltd.

(3) Wet-method

"Dispercoat" (Trademark), made by Nisshin Flour Milling Co., Ltd.

"Coatmizer" (Trademark), made by Freund Industrial Co., Ltd.

(4) Heat-treatment method

"Surfusing" (Trademark), made by Nippon Pneumatic Mfg. Co., Ltd.

(5) Others

"Spray dry" (Trademark), made by Ohgawara Kakouki Co., Ltd.

The finely-divided particles with a high hardness, for example, finely-divided particles of metallic oxides such as alumina and zirconia are used as the abrasive particles 15 for use in the present invention. When the developer of the present invention is applied to the a-Si based photoconductor comprising a surface protective layer comprising SiC, it is preferable to use as the abrasive particles 15 the finely-divided particles with a Mohs hardness of 8 or more, preferably from 8 to 9 because SiC for use in the surface protective layer of the photoconductor has a Mohs hardness of about 8.

When each of the finely-divided abrasive particles has an average particle diameter d, and the toner basic particle has an average particle diameter D, it is preferable that the ratio of D/d be in the range of 10 to 50, and more preferably in the range of 10 to 40. When the ratio of D/d is within the above range, the abrasive particles 15 can securely be fixed to the surface of the toner basic particle 13 and the abrasive effect can be improved.

The abrasive particles 15 for use in the present invention may be surface-treated to control the charging characteristics of the toner and to make the toner particles hydrophobic. In addition, finely-divided particles of other materials may be used in combination with the abrasive particles 15 for the purpose of adjusting the fluidity of the toner.

The toner basic particle 13 for use in the present invention, the formulation of which is similar to that of the conventional toner particle, comprises a binder resin, coloring agent, a charge controlling agent and an off-set preventing agent.

A magnetic toner can be prepared by the addition of a magnetic material to the above-mentioned components. More specifically, magnetic materials such as magnetite and ferrite may be contained in the toner basic particle 13, or the magnetic particles may be fixed on the surface of the toner basic particle 13 together with the abrasive particles 15.

In the case where the abrasive-type toner for use in the present invention is a magnetic toner, it is preferable that the saturation magnetization of the toner in a magnetic field of 5 kOe be 2 to 20 emu/g, more preferably 3 to 15 emu/g, and further preferably 5 to 10 emu/g. When the saturation magnetization of the toner is within the above range, the scattering of toner particles in the image forming apparatus can effectively be prevented, and at the same time, a sufficiently high image density can be obtained.

Examples of the binder resin for use in the toner particle 11 are vinyl resins, for instance, polystyrene resin including styrene-acryl copolymer, and polyester resins.

As the coloring agent for use in the toner particle 11, a variety of dyes and pigments such as carbon black can be used.

Examples of the charge controlling agent for use in the toner are quaternary ammonium compounds, nigrosine, bases of nigrosine, crystal violet and triphenylmethane compounds.

As the off-set preventing agent or image-fixing promoting assistant, olefin waxes such as low molecular weight polypropylene, low molecular weight polyethylene and modified materials of the above compounds can be employed in the present invention.

As the magnetic material for preparing the magnetic toner, magnetite and ferrite can be used as previously mentioned.

The toner basic particles 13 for use in the present invention can be obtained by mixing and kneading the above-mentioned components under application of heat thereto in a two-roll mill and kneader, pulverizing in a jet-mill and then classifying the obtained particles according to the conventional methods.

It is preferable that the average particle diameter of the toner particle 11 be 20 μm or less, more preferably 15 μm or less.

Since the toner particles 11 for use in the present invention comprises abrasive particles 15, as previously mentioned, the surfaces of the magnetic particles for use in the magnetic powder carrier are abraded by the toner particles during the stirring and mixing process for preparation of the developer, thereby removing the spent toner attached to the surfaces of the magnetic particles. Therefore, the spent toner on the carrier is not accumulated and the amount of the spent toner does not exceed a certain level, so that the high quality images can be obtained over a long period of time.

The amount of the above-mentioned spent toner attached to a mixture of the magnetic resin carrier and the magnetic powder carrier can be determined by measuring the resistivity of the mixture of the two kinds of carriers and the total amount of carbon contained in the mixture of the two kinds of carriers. In the case where the resin for use in the magnetic resin carrier is insoluble in a solvent, the amount of the spent toner attached to the carrier can be measured in accordance with the method described in the paper entitled "Investigation on Magnetic Brush Development Device" by Takafumi Arimura in the Journal of the Institute of Electrophotography Engineers of Japan, vol. 9, No. 2, (1981). Furthermore, the measuring accuracy can be improved by the determination of a specific constituent element of the carrier, except carbon.

In addition, when image formation is carried out by use of the toner particles 11 as previously mentioned, the surface of the photoconductor can effectively be abraded by the toner particles 11 while the toner particles 11 are in contact with the surface of the photoconductor and rubbed against the same in the development process and cleaning process. With the above-mentioned advantageous function of the toner particles 11 taken into consideration, the toner particles for use in the present invention are particularly suitable to the a-Si based photoconductor comprising a surface protective SiC layer.

When the two kinds of magnetic carriers are used in combination with the abrasive-type magnetic toner in the present invention, the toner particles are attracted to the carrier particles due to the electrostatic force by charging, and the magnetic force. In this case, the scattering of the toner particles in the image forming apparatus, especially the scattering thereof depending upon the environmental change, can effectively be avoided.

Figure 2:
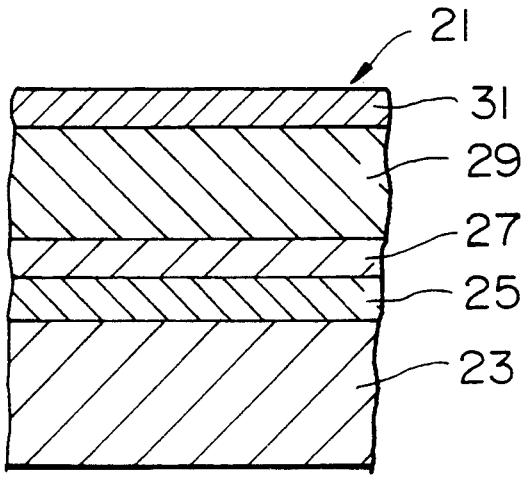
FIG. 2 is a cross-sectional view of one embodiment of an a-silicon based photoconductor for use in the present invention.

FIG. 2 is a cross-sectional view of one embodiment of an a-Si based photoconductor 21 for use in the present invention. The a-Si based photoconductor 21 comprises an electroconductive support 23, and a light-absorbing layer 25 with a thickness of 0.2 to 5 μm, comprising Si, Ge and H, a carrier-injection preventing layer 27 with a thickness of 0.2 to 4 μm, comprising Si, H, B and O, a carrier-excitation-and-transport layer 29 with a thickness of 15 to 30 μm, that is, a photoconductive layer, comprising Si and H and a surface protective layer 31 with a thickness of 0.3 to 1 μm, which are successively overlaid on the electroconductive support 23 in this order.

The representative material for the surface protective layer 31 for use in the a-Si based photoconductor is silicon carbide (SiC). The surface protective layer 31 comprising SiC is not smooth, but provided with a number of minute cones thereon. In addition, the hydrophilic nature of the protective layer 31 is so strong that ion products generated by the corona discharge are easily attached thereto. Practically, when the continuous printing operation is carried out or the printing operation is initiated in the atmosphere of high humidities, the problem of toner filming occurs, and a hydrophilic compound, such as ammonium nitrate, which is generated in the form of an ion product, is easily attached to the surface protective layer 31 of the photoconductor 21. As a result, the electric charge on the surface of the photoconductor leaks therefrom, and consequently the so-called blurring is caused. The above-mentioned ion products are apt to be collected in depressions between the cones of the surface protective SiC layer 31, so that the blurring cannot be avoided by the conventional cleaning procedure.

When the abrasive-type toner particles for use in the present invention are employed for the image forming method of the present invention, the tip of each cone on the surface protective layer 31 can be abraded by the toner particles to make the surface of the photoconductor 21 smooth, and at the same time, the ion products accumulated in the depressions between the cones can be scraped therefrom. Thus, the blurring of images can effectively be avoided, and the development stability can thus be ensured. In addition, although the toner particles for use in the present invention have such an abrasion effect, the surface of the photoconductor is not damaged by the toner particles when the surface of the photoconductor is abraded with the abrasive-type toner using a pressure-contact member such as a cleaning blade or a sliding roller, which is brought into pressure contact with the surface of the photoconductor.

The image forming method of the present invention will now be explained in detail with reference to FIG. 3.

Figure 3:
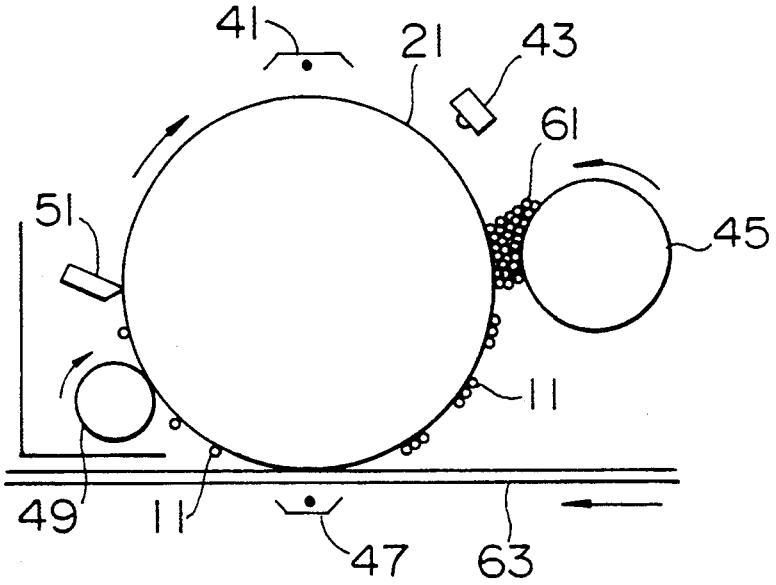
FIG. 3 is a schematic cross-sectional view of an embodiment of an image forming apparatus for carrying out the image formation according to the method of the present invention.

The structure of an image forming apparatus shown in FIG. 3 is similar to that of the conventional one except that a sliding roller 49 is provided in pressure contact with the surface of a photoconductor 21.

Around the drum-shaped a-Si based photoconductor 21 comprising a surface protective SiC layer with a thickness of about 0.3 to 1 μm, there are situated a corona charger 41, an LED head 43 serving as an exposure means, a development roller 45, an image-transfer unit 47, a sliding roller 49 and a cleaning blade 51. The surface of the photoconductor 21 is uniformly charged to a predetermined polarity by the corona charger 41, and the photoconductor 21 thus charged is selectively exposed to original right images by use of the LED head 43 to form latent electrostatic images on the photoconductor 21. Then, a developer 61 is supplied to the surface of the photoconductor 21 by the development roller 45, so that the latent electrostatic images are developed into visible images comprising toner particles 11. When the toner particles 11 in the developer 61 are brought into contact with the surface protective SiC layer of the photoconductor 21 in the development process, the surface protective SiC layer is abraded therewith. Since the abrasive particles 15 are steadily fixed to the surface of the toner basic particle 13 so as not to fall off the toner basic particle 13, the abrasive-type toner particles 11 do not cause the defective development and do not bring about poor results of the obtained images.

The visible images comprising the toner particles 11 formed on the photoconductor 21 are transferred to an image-receiving medium, such as a sheet of paper 63, by use of the image-transfer unit 47, and then fixed thereon by use of an image-fixing unit (not shown).

In the image-transfer process, all of the toner particles 11 attached to the surface of the photoconductor 21 are not transferred to a sheet of paper 63, and some toner particles 11 remain on the photoconductor 21. These residual toner particles 11 are pressed against the photoconductor 21 and the surface protective SiC layer of the photoconductor 21 is further abraded by the abrasive particles 15 of the toner particles 11 when the sliding roller 49 is brought into rolling contact with the photoconductor 21. The abrasive effect can be further achieved by the abrasive-type toner particles 11 with respect to the surface protective SiC layer.

Thereafter, the residual toner particles 11 on the photoconductor 21 are removed therefrom by the cleaning blade 51. In this cleaning process, the surface protective SiC layer of the photoconductor 21 is again abraded with the abrasive particles 15 of the toner particles 11 because a mechanical force is generated between the cleaning blade 51 and the photoconductor 21.

An elastic roller is used for the sliding roller 49 for use in the present invention. The surface protective SiC layer is abraded and cleaned with the abrasive particles 15 of the toner particles 11 when the sliding roller is brought into pressure contact with the surface of the photoconductor 21 and rotated in such a fashion that a shearing stress is applied to the photoconductor 21.

Furthermore, the blurring problem can more effectively be solved by heating the photoconductor 21 with a heater provided inside of the photoconductor 21.

The effect of the abrasive-type toner particles for use in the present invention has been explained with reference to the image forming apparatus shown in FIG. 3, which employs the a-Si based photoconductor comprising the surface protective SiC layer. The abrasive-type toner particles for use in the present invention are applicable to any other photoconductors comprising different kinds of surface protective layers by adjusting the hardness of the abrasive particles for use in the toner particles depending on the hardness of the surface layer of the photoconductor to be employed.

According to the present invention, the developer comprises a magnetic resin carrier, a magnetic powder carrier, and an abrasive-type toner. Therefore, a charge quantity required for the toner can freely be determined by using the two kinds of carriers in combination, and steadily be imparted to the toner. In addition, the accumulation of the spent material deposited on the carrier can be avoided, thereby preventing the occurrence of fogging and defective images. Thus, high quality images can be produced over a long period of time and it is not necessary to replace the developer at short intervals.

Further, deterioration of the developer caused by stirring in the development unit can be minimized, so that the durability and stability of the developer is satisfactory. As a result, high quality images can be ensured over a long period of time.

By using the magnetic resin carrier for the developer, sharp images can be obtained with excellent gradation. In addition, the problem of the magnetic resin carrier being attracted to the photoconductor together with the toner can be solved because the magnetic resin carrier and the magnetic powder carrier are used in combination.

In the present invention, excellent abrasiveness can be achieved with respect to the surface of the photoconductor by using the abrasive-type toner. As a result, the apparatus capable of forming images by the image forming method of the present invention can be made compact because it is not necessary to provide a special system for cleaning the photoconductor, such as a cleaning brush. In view of the excellent abrasiveness of the developer of the present invention, the developer of the present invention is regarded as especially appropriate for a small-sized image forming apparatus equipped with a photoconductor with a small diameter, and an image forming apparatus equipped with an a-Si based photoconductor which conventionally necessitates a large-sized cleaning brush because the surface layer of the a-Si photoconductor is remarkably hard.

Other features of this invention will become apparent in the course of the following description of exemplary embodiments, which are given for illustration of the invention and are not intended to be limiting thereof.

EXAMPLE 1

[Preparation of Magnetic Resin Carrier]

In accordance with the method described in Japanese Laid-Open Patent Application 2-220068, a mixture of phenol and formalin was caused to undergo condensation in an aqueous medium in the presence of magnetite, so that a magnetic resin carrier comprising 85 wt. % of magnetite and 15 wt. % of phenolic resin was prepared. The average particle diameter of the thus obtained magnetic resin carrier was 60 μm; the specific gravity, 3.0; the resistivity, $10^7$ Ω.cm; and the saturation magnetization in an electrical field of 5 kOe, 76 emu/g.

[Preparation of Magnetic Powder Carrier]

$Fe_2O_3$.CuO.ZnO based ferrite particles were prepared for a non-coated magnetic carrier for use in the present invention. The average particle diameter of the thus obtained magnetic powder carrier was 60 μm; the resistivity, $10^8$ Ω.cm; and the saturation magnetization in an electrical field of 5 kOe, 68 emu/g.

[Preparation of Abrasive-type Toner]

A mixture of the following components was thoroughly kneaded and pulverized in a high-speed mixer, and then classified, so that toner basic particles with an average particle diameter of 10 μm were obtained:

| | Parts by Weight |
|---|---|
| Styrene/n-butyl acrylate copolymer (ratio: 80/20) | 90 |
| Carbon black "MA-100" (Trademark), made by Mitsubishi Chemical Industries, Ltd. | 5 |
| Polypropylene wax "Viscol 550P" (Trademark), made by Sanyo Chemical Industries, Ltd. | 3 |
| Charge controlling agent "Copy Blue PR" (Trademark), made by Hoechst Japan Limited. | 2 |

Finely-divided particles of alumina with an average particle diameter of 0.4 μm, serving as abrasive particles, were added to the above obtained toner basic particles in an amount of 5 wt. %. Then, the alumina particles were fixed to the surfaces of the toner basic particles by the application of mechanical shock thereto using a commercially available surface modification apparatus "Hybridization System" (Trademark), made by Nara Machinery Co., Ltd. Thus, abrasive-type toner particles comprising alumina particles which were firmly fixed to the surfaces of the toner basic particles were obtained. The Mohs hardness of the alumina particles was 9 and the surface of the alumina particles had an abrasive property.

[Preparation of Developer]

20 wt. % of the above prepared magnetic resin carrier, 75 wt. % of the magnetic powder carrier and 5 wt. % of the abrasive-type toner were mixed to prepare a developer No. 1 according to the present invention.

COMPARATIVE EXAMPLE 1

[Preparation of Toner]

A mixture of the following components was thoroughly kneaded and pulverized in a high-speed mixer, and then classified, so that toner particles with an average particle diameter of 10 μm were obtained:

| | Parts by Weight |
|---|---|
| Styrene/n-butyl acrylate copolymer (ratio: 80/20) | 90 |
| Carbon black "MA-100" (Trademark), made by Mitsubishi Chemical Industries, Ltd. | 5 |
| Polypropylene wax "Viscol 550P" (Trademark), made by Sanyo Chemical Industries, Ltd. | 3 |
| Charge controlling agent "Copy Blue PR" (Trademark), made by Hoechst Japan Limited. | 2 |

[Preparation of Developer]

20 wt. % of the same magnetic resin carrier as used in Example 1, 75 wt. % of the same magnetic powder carrier as used in Example 1 and 5 wt. % of the above prepared toner not comprising the abrasive particles were mixed to prepare a comparative developer No. 1.

COMPARATIVE EXAMPLE 2

95 wt. % of the same magnetic powder carrier as used in Example 1 and 5 wt. % of the same toner as used in Comparative Example 1 were mixed to prepare a comparative developer No. 2.

Figure 4:
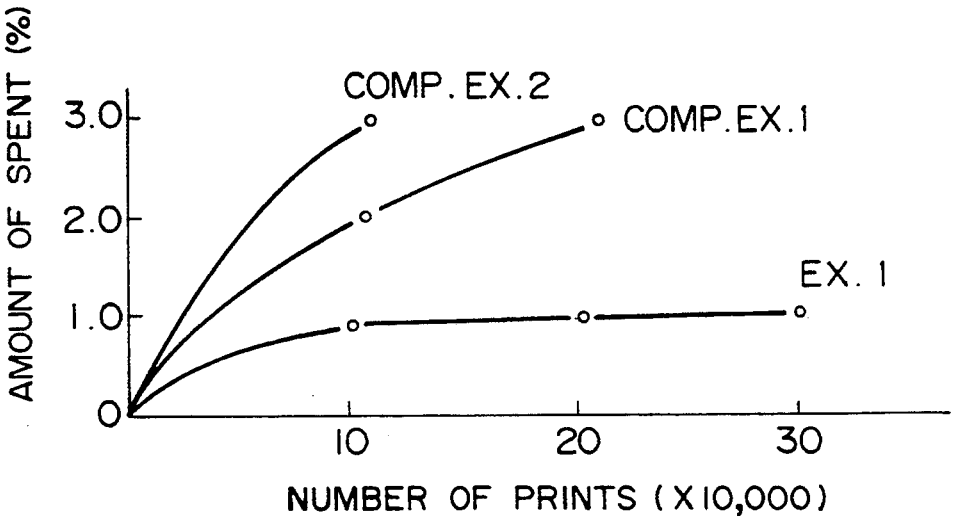
FIG. 4 is a graph in explanation of the relationship between the number of sheets of paper subjected to the continuous printing operation and the spent amount attached to the carrier.

Each of the above obtained developer No. 1 according to the present invention and comparative developers Nos. 1 and 2 was supplied to a commercially available LED printer "FS-1500" (Trademark), made by Kyocera Corp., to carry out continuous printing of 300,000 sheets of paper. Every after the continuous printing of 100,000 sheets of paper, the amount of the spent material attached to the carrier in each developer was obtained by measuring the total weight of carbon contained in the carrier, and the spent amount was expressed by percentage. The results are shown in FIG. 4.

In addition, the image quality was evaluated at the initial stage of the continuous printing, after the making of print of 100,000 sheets and after the making of print of 200,000 sheets, and the following printing characteristics were assessed in accordance with the following scale. The results are shown in Table 1.

(1) Attraction of carrier to the photoconductor

○: No carrier particles were attracted to the photoconductor.

Δ: The attraction of the carrier particles to the photoconductor was slightly observed.

x: There were defective images due to the attraction of the carrier particles to the photoconductor.

(2) Fogging

○: No fogging was observed on the obtained images.

Δ: Fogging was slightly observed on the obtained images.

x: Fogging was apparent on the obtained images.

TABLE 1

| | Attraction of Carrier Particles to Photoconductor | | | Fogging | | |
|---|---|---|---|---|---|---|
| | At Initial Stage | After Print of 100,000 Sheets | After Print of 200,000 Sheets | At Initial Stage | After Print of 100,000 Sheets | After Print of 200,000 Sheets |
| Ex. 1 | ○ | ○ | ○ | ○ | ○ | Δ |
| Comp. Ex. 1 | ○ | ○ | ○ | ○ | Δ | X |
| Comp. Ex. 2 | ○ | ○ | — | X | X | — |

Furthermore, each of the developer No. 1 of the present invention and the comparative developer No. 1 was supplied to the image forming apparatus as shown in FIG. 3 to carry out continuous printing of 300,000 sheets of paper. This image forming apparatus employed an a-Si based photoconductor comprising an electroconductive support, and a light-absorbing layer comprising Si, Ge and H, a carrier-injection preventing layer comprising Si, H, B and O, a carrier-excitation-and-transport layer comprising Si and H and a surface protective SiC layer with a thickness of 5000 Å which were successively overlaid on the electroconductive support in this order.

By the above-mentioned continuous printing test, the following items were evaluated:

(1) Image defect in terms of dot reproduction

The image defect was accessed in accordance with the following scale:

○: The image defect in terms of dot reproduction was never observed.

Δ: The image defect in terms of dot reproduction was slightly observed.

x: The image defect in terms of dot reproduction was observed at many positions.

(2) Blurring

○: No blurring appeared in the obtained images.

Δ: Blurring was slightly observed in the obtained images.

x: Blurring was observed on all over the printed sheet.

The results of the above-mentioned evaluations are shown in Table 2.

Furthermore, the thickness of the surface protective SiC layer of the α-Si based photoconductor was measured by an X-ray photoelectron spectroscope (XPS) after the making of print of 300,000 sheets of paper. The results are also shown in Table 2.

In addition, the surface protective SiC layer was observed by a scanning-type electron microscope (SEM) at a magnification of 5,000×. As a result, the minute cones on the surface protective SiC layer were slightly abraded and this layer was made smoother after the making of print of 300,000 sheet when compared with the initial stage of the continuous printing operation.

TABLE 2

| | Image Defect in Terms of Dot Reproduction | Blurring | Thickness of SiC Layer after Printing of 300,000 sheets |
|---|---|---|---|
| Ex. 1 | ○ | ○ | 4,000 Å |
| Comp. Ex. 1 | ○ | x | 5,000 Å |

EXAMPLE 2

[Preparation of Coated-type Magnetic Resin Carrier]

In accordance with the method described in Japanese Laid-Open Patent Application 2-220068, a mixture of phenol and formalin was caused to undergo condensation in an aqueous medium in the presence of magnetite, so that core magnetic resin particles for a coated-type magnetic resin carrier comprising 85 wt. % of magnetite and 15 wt. % of phenolic resin were prepared. The resistivity of these core magnetic resin particles was $10^8$ Ω.cm.

Silicone resin was added to the above prepared core magnetic resin particles in an amount of 3 wt. % in such a fashion that the core particles were coated with the silicone resin. The silicone-resin-coated magnetic resin particles were dried to cure the silicone resin layer, so that a coated-type magnetic resin carrier was obtained. The average particle diameter of the thus obtained coated-type magnetic resin carrier was 60 μm; the specific gravity, 3.0; the resistivity, $10^{10}$ Ω.cm; and the saturation magnetization in an electrical field of 5 kOe, 68 emu/g.

[Preparation of Developer]

20 wt. % of the above prepared coated-type magnetic resin carrier, 75 wt. % of the same magnetic powder carrier as used in Example 1 and 5 wt. % of the same abrasive-type toner as used in Example 1 were mixed to prepare a developer No. 2 according to the present invention.

COMPARATIVE EXAMPLE 3

20 wt. % of the same coated-type magnetic resin carrier as used in Example 2, 75 wt. % of the same magnetic powder carrier as used in Example 2 and 5 wt. % of the same toner not comprising abrasive particles as used in Comparative Example 1 were mixed to prepare a comparative developer No. 3.

COMPARATIVE EXAMPLE 4

95 wt. % of the same magnetic powder carrier as used in Example 1 and 5 wt. % of the same toner as used in Comparative Example 1 were mixed to prepare a comparative developer No. 4.

Figure 5:
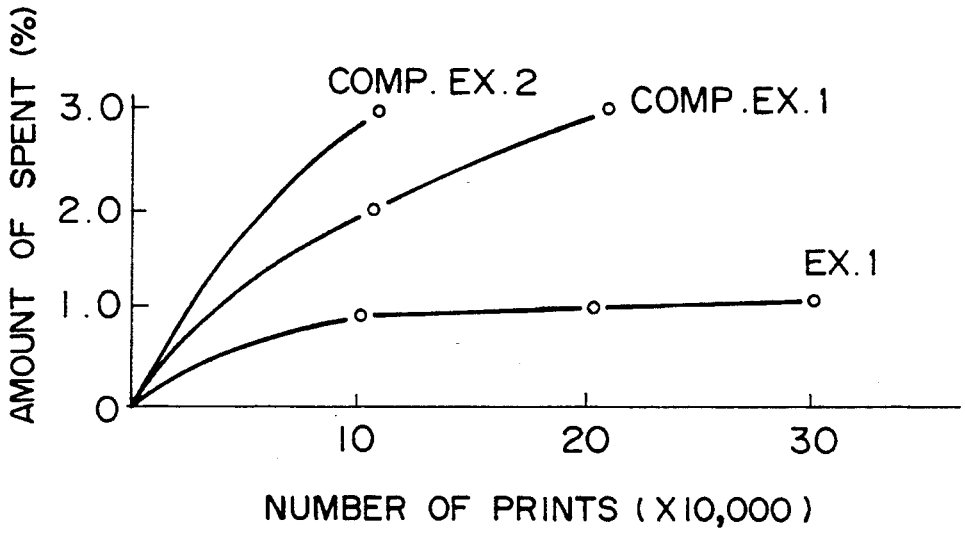
FIG. 5 is a graph in explanation of the relationship between the number of sheets of paper subjected to the continuous printing operation and the spent amount attached to the carrier.

Each of the above obtained developer No. 2 according to the present invention and comparative developers Nos. 3 and 4 was supplied to a commercially available LED printer "FS-1500" (Trademark), made by Kyocera Corp., to carry out continuous printing of 300,000 sheets of paper. Every after the continuous printing of 100,000 sheets of paper, the amount of the spent material attached to the carrier in each developer was measured and calculated in the same manner as in Example 1. The results are shown in FIG. 5.

Furthermore, each of the developer No. 2 of the present invention and the comparative developer No. 3 was supplied to the same image forming apparatus as employed in Example 1 to carry out continuous printing of 300,000 sheets of paper.

By the above-mentioned continuous printing test, the image defect in terms of dot reproduction and the blurring were evaluated in the same manner as in Example 1. The results of the above-mentioned evaluations are shown in Table 3.

Furthermore, the thickness of the surface protective SiC layer of the a-Si based photoconductor was measured by the XPS after the making of print of 300,000 sheets of paper. The results are also shown in Table 3.

In addition, the surface protective SiC layer was observed by a scanning-type electron microscope (SEM) at a magnification of 5,000×. As a result, the minute cones on the surface protective SiC layer were slightly abraded and this layer was made smoother after the making of print of 300,000 sheet when compared with the initial stage of the continuous printing operation.

TABLE 3

| | Image Defect in Terms of Dot Reproduction | Blurring | Thickness of SiC Layer after Printing of 300,000 sheets |
|---|---|---|---|
| Ex. 2 | ○ | ○ | 4,000 Å |
| Comp. Ex. 3 | ○ | x | 5,000 Å |

EXAMPLE 3

The procedure for preparation of the developer No. 2 according to the present invention in Example 2 was repeated except that the mixing ratio of the coated-type magnetic resin carrier, the magnetic powder carrier, and the abrasive-type toner was changed as shown in Table 4. Thus, developers Nos. 3-2 and 3-3 according to the present invention, and comparative developers Nos. 3-1 and 3-4 were separately obtained.

TABLE 4

| Developer No. | Mixing Ratio of Coated-type Magnetic Resin Carrier/Magnetic Carrier/Abrasive-type Toner |
|---|---|
| 3-1 | 95/0/5 |
| 3-2 | 25/70/5 |
| 3-3 | 15/80/5 |
| 3-4 | 0/95/5 |

Each of the above obtained developers Nos. 3-2 and 3-3 of the present invention and comparative developers Nos. 3-1 and 3-4 was supplied to a commercially available LED printer "FS-1500" (Trademark), made by Kyocera Corp., to carry out continuous printing of 200,000 sheets of paper. After the completion of the continuous printing of 200,000 sheets of paper, the attraction of carrier to the photoconductor, and the fogging were evaluated in the same manner as in Example 1. The results are shown in Table 5.

TABLE 5

| Developer No. | Attraction of Carrier to Photoconductor after Printing of 200,000 Sheets | Fogging after Printing of 200,000 Sheets |
|---|---|---|
| 3-1 | x | Δ |
| 3-2 | ○ | ○ |
| 3-3 | ○ | ○ |
| 3-4 | ○ | x |

EXAMPLE 4

[Preparation of Abrasive-type Magnetic Toner]

A mixture of the following components was thoroughly kneaded and pulverized in a high-speed mixer, and then classified, so that toner basic particles with an average particle diameter of 10 μm were obtained:

| | Parts by Weight |
|---|---|
| Styrene/n-butyl acrylate copolymer (ratio: 80/20) | 83 |
| Magnetite "EPT-1000" (Trademark), made by Toda Kogyo Corp. | 5 |
| Carbon black "MA-100" (Trademark), made by Mitsubishi Chemical Industries, Ltd. | 5 |
| Polypropylene wax "Viscol 550P" (Trademark), made by Sanyo Chemical Industries, Ltd. | 5 |
| Charge controlling agent "Copy Blue PR" (Trademark), made by Hoechst Japan Limited. | 2 |

Finely-divided particles of alumina with an average particle diameter of 0.4 μm, serving as abrasive particles, were added to the above obtained toner basic particles in an amount of 5 wt. %. Then, the alumina particles were fixed to the surfaces of the toner basic particles by the application of mechanical shock thereto using a commercially available surface modification apparatus "Hybridization System" (Trademark), made by Nara Machinery Co., Ltd. Thus, abrasive-type magnetic toner particles comprising alumina particles which were firmly fixed to the surfaces of the toner basic particles were obtained. The Mohs hardness of the alumina particles was 9 and the surface of the alumina particles had an abrasive property. The saturation magnetization of the thus obtained magnetic toner was 4.0 emu/g in a magnetic field of 5 kOe.

[Preparation of Developer]

20 wt. % of the same coated-type magnetic resin carrier as used in Example 2, 75 wt. % of the same magnetic powder carrier as used in Example 2 and 5 wt. % of the above prepared abrasive-type magnetic toner were mixed to prepare a developer No. 4 according to the present invention.

COMPARATIVE EXAMPLE 5

[Preparation of Toner]

A mixture of the following components was thoroughly kneaded and pulverized in a high-speed mixer, and then classified, so that toner particles with an average particle diameter of 10 μm were obtained:

| | Parts by Weight |
|---|---|
| Styrene/n-butyl acrylate copolymer (ratio: 80/20) | 83 |
| Magnetite "EPT-1000" (Trademark), made by Toda Kogyo Corp. | 5 |
| Carbon black "MA-100" (Trademark), made by Mitsubishi Chemical Industries, Ltd. | 5 |
| Polypropylene wax "Viscol 550P" (Trademark), made by Sanyo Chemical Industries, Ltd. | 5 |
| Charge controlling agent "Copy Blue PR" (Trademark), made by Hoechst Japan Limited. | 2 |

[Preparation of Developer]

20 wt. % of the same coated-type magnetic resin carrier as used in Example 2, 75 wt. % of the same magnetic powder carrier as used in Example 2 and 5 wt. % of the above prepared toner not comprising the abrasive particles were mixed to prepare a comparative developer No. 5.

COMPARATIVE EXAMPLE 6

95 wt. % of the same magnetic powder carrier as used in Example 2 and 5 wt. % of the same toner as used in Comparative Example 5 were mixed to prepare a comparative developer No. 6.

Figure 6:
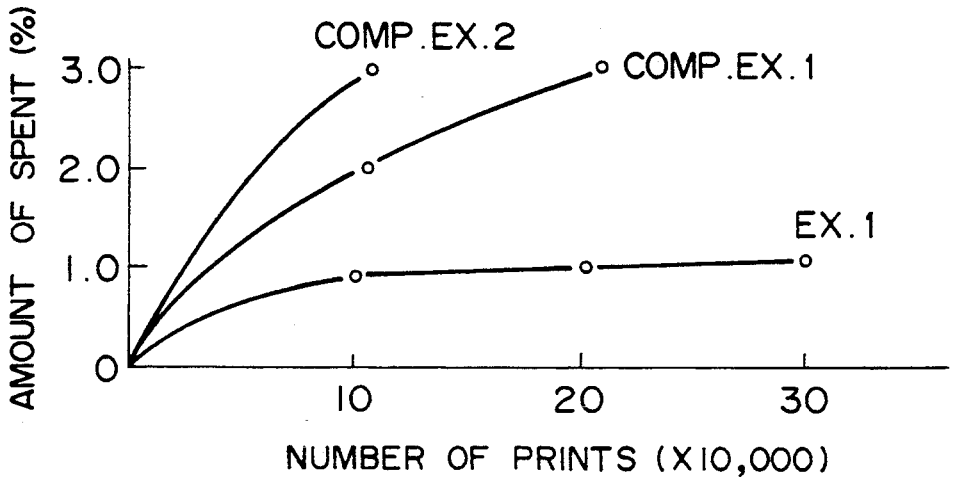
FIG. 6 is a graph in explanation of the relationship between the number of sheets of paper subjected to the continuous printing operation and the spent amount attached to the carrier.

Each of the above obtained developer No. 4 according to the present invention and comparative developers Nos. 5 and 6 was supplied to a commercially available LED printer "FS-1500" (Trademark), made by Kyocera Corp., to carry out continuous printing of 300,000 sheets of paper. Every after the continuous printing of 100,000 sheets of paper, the amount of the spent material attached to the carrier in each developer was measured and calculated in the same manner as in Example 1. The results are shown in FIG. 6.

In addition, the attraction of the carrier particles to the photoconductor, and the appearance of fogging in the obtained images were evaluated at the initial stage of the continuous printing, after the making of print of 100,000 sheets and after the making of print of 200,000 sheets in accordance with the same scale as in Example 1. This continuous printing was carried out at 35° C. and 85% RH. The results are shown in Table 6.

In the course of the continuous printing test, it was checked whether the toner particles were scattered in the image forming apparatus or not. The scattering of toner particles in the apparatus was assessed in accordance with the following scale:

○: There was no stain of toner particles in the image forming apparatus.

Δ: Slight stain was observed in the image forming apparatus.

x: The inside of the image forming apparatus was terribly stained with toner particles, and the rear side of paper was also stained therewith.

The results of the scattering of toner particles are also shown in Table 6.

TABLE 6

| | Attraction of Carrier Particles to Photoconductor | | | Fogging | | | Scattering of Toner in Apparatus | | |
|---|---|---|---|---|---|---|---|---|---|
| | At Initial Stage | After Print of 100,000 Sheets | After Print of 200,000 Sheets | At Initial Stage | After Print of 100,000 Sheets | After Print of 200,000 Sheets | At Initial Stage | After Print of 1000,000 Sheets | After Print of 200,000 Sheets |
| Ex. 4 | ○ | ○ | ○ | ○ | ○ | ○ | ○ | ○ | ○ |
| Comp. Ex. 5 | ○ | ○ | ○ | Δ | Δ | X | Δ | X | X |
| Comp. Ex. 6 | ○ | ○ | — | X | X | — | Δ | X | — |

Furthermore, each of the developer No. 4 of the present invention and the comparative developer No. 5 was supplied to the image forming apparatus as shown in FIG. 3 to carry out continuous printing of 300,000 sheets of paper.

By the above-mentioned continuous printing test, the image defect in terms of dot reproduction and the blurring were evaluated in the same manner as in Example 1. The results of the above-mentioned evaluations are shown in Table 7.

Furthermore, the thickness of the surface protective SiC layer of the a-Si based photoconductor was measured by the XPS after the making of print of 300,000 sheets of paper. The results are also shown in Table 7.

TABLE 7

| | Image Defect in Terms of Dot Reproduction | Blurring | Thickness of SiC Layer after Printing of 300,000 sheets |
|---|---|---|---|
| Ex. 4 | ○ | ○ | 4,000 Å |
| Comp. Ex. 5 | ○ | x | 5,000 Å |

What is claimed is:

1. A developer for developing latent electrostatic images to visible images, comprising:

a magnetic resin carrier comprising magnetic resin particles, each of said magnetic resin particles comprising a binder resin and finely-divided magnetic particles dispersed in said binder resin;

a magnetic powder carrier consisting essentially of magnetic particles; and an abrasive-type toner comprising toner particles, each of said toner particles comprising a toner basic particle and finely-divided particles of an abrasive substance which are fixed on the surface of said toner basic particle.

2. The developer as claimed in claim 1, wherein the surface of each of said magnetic resin particles for said magnetic resin carrier is coated with a resin.

3. The developer as claimed in claim 1, wherein the surface of each of said magnetic particles for said magnetic powder carrier is coated with a resin.

4. The developer as claimed in claim 1, wherein said toner is non-magnetic.

5. The developer as claimed in claim 1, wherein said toner is magnetic.

6. The developer as claimed in claim 1, wherein said magnetic resin carrier has a saturation magnetization of 60 to 90 emu/g in a magnetic field of 5 kOe.

7. The developer as claimed in claim 1, wherein said magnetic powder carrier has a saturation magnetization of 55 to 90 emu/g in a magnetic field of 5 kOe.

8. The developer as claimed in claim 5, wherein said abrasive-type toner has a saturation magnetization of 2 to 20 emu/g in a magnetic field of 5 kOe.

9. The developer as claimed in claim 1, wherein said magnetic resin carrier has an average particle diameter of to 80 μm.

10. The developer as claimed in claim 1, wherein said magnetic powder carrier has an average particle diameter of 20 to 80 μm.

11. The developer as claimed in claim 1, wherein said abrasive-type toner has an average particle diameter of 20 μm or less.

12. The developer as claimed in claim 1, wherein said magnetic particles for said magnetic powder carrier are ferrite particles.

13. The developer as claimed in claim 1, wherein the mixing ratio by weight of said magnetic resin carrier to said magnetic powder carrier is in the range of (5–75):(95–25).

14. The developer as claimed in claim 1, wherein the mixing ratio by weight of said magnetic resin carrier to said magnetic powder carrier is in the range of (5–50) : (95–50).

15. The developer as claimed in claim 1, wherein said finely-divided particles of said abrasive substance have a Mohs hardness of 8 or more.

16. The developer as claimed in claim 1, wherein said finely-divided particles of said abrasive substance have a Mohs hardness of 8 to 9.

17. The developer as claimed in claim 1, wherein each of said finely-divided abrasive particles has an average particle diameter d, and said toner basic particle has an average particle diameter D, with the ratio of D/d being in the range of 10 to 50.

18. A method of forming images comprising the steps of:

forming latent electrostatic images on the surface of an amorphous-silicon-based photoconductive layer of an amorphous-silicon-based photoconductor; and developing said latent electrostatic images to visible toner images formed on said amorphous-silicon-based photoconductive layer by use of a developer comprising (a) a magnetic resin carrier comprising magnetic resin particles, each of said magnetic resin particles comprising a binder resin and finely-divided magnetic particles dispersed in said binder resin, (b) a magnetic powder carrier consisting essentially of magnetic particles, and (c) an abrasive-type toner comprising toner particles, each of said toner particles comprising a toner basic particle and finely-divided particles of an abrasive substance which are fixed on the surface of said toner basic particle.

19. The method of forming images as claimed in claim 18, wherein the surface of each of said magnetic resin particles for said magnetic resin carrier is coated with a resin.

20. The method of forming images as claimed in claim 18, wherein the surface of each of said magnetic particles for said magnetic powder carrier is coated with a resin.

21. The method of forming images as claimed in claim 18, wherein said abrasive-type toner is non-magnetic.

22. The method of forming images as claimed in claim 18, wherein said abrasive-type toner is magnetic.

23. The method of forming images as claimed in claim 22, wherein said abrasive-type toner has a saturation magnetization of 2 to 20 emu/g in a magnetic field of 5 kOe.

24. The method of forming images as claimed in claim 18, wherein said magnetic resin carrier has an average particle diameter of 20 to 80 μm, said magnetic powder carrier has an average particle diameter of 20 to 80 μm, and said abrasive-type toner has an average particle diameter of 20 μm or less.

25. The method of forming images as claimed in claim 18, wherein said magnetic particles for said magnetic powder carrier are ferrite particles.

26. The method of forming images as claimed in claim 18, wherein the mixing ratio by weight of said magnetic resin carrier to said magnetic powder carrier is in the range of (5–75):(95–25).

27. The method of forming images as claimed in claim 18, wherein said finely-divided particles of said abrasive substance have a Mohs hardness of 8 or more.

28. The method of forming images as claimed in claim 18, wherein each of said finely-divided abrasive particles has an average particle diameter d, and said toner basic particle has an average particle diameter D, with the ratio of D/d being in the range of 10 to 50.

29. The method of forming images as claimed in claim 18, wherein said amorphous-silicon based photoconductor further comprises a surface protective layer comprising SiC.

30. The method of forming images as claimed in claim 29, wherein said surface protective layer has a thickness of 0.3 to 1 μm.

31. The method of forming images as claimed in claim 18, further comprising the steps of:

transferring said toner images formed on said amorphous-silicon based photoconductor to an image-receiving medium, and abrading the surface of said amorphous-silicon based photoconductor with said abrasive-type toner remaining on said amorphous-silicon-based photoconductor, using a pressure-contact member which is brought into pressure contact with the surface of said amorphous-silicon-based photoconductor, after the transfer of said toner images to said image-receiving medium.

* * * * *